US007224912B2

(12) United States Patent
Rommelmann et al.

(10) Patent No.: US 7,224,912 B2
(45) Date of Patent: May 29, 2007

(54) METHOD OF PROVIDING DEVICE USAGE DATA

(75) Inventors: Heiko Rommelmann, Penfield, NY (US); Alberto Rodriguez, Webster, NY (US); Scott Jonathan Bell, Rochester, NY (US); Perry Pesce, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 149 days.

(21) Appl. No.: 11/013,703

(22) Filed: Dec. 17, 2004

(65) Prior Publication Data

US 2006/0133828 A1 Jun. 22, 2006

(51) Int. Cl.
*G03G 15/00* (2006.01)

(52) U.S. Cl. ..... 399/8; 399/111

(58) Field of Classification Search ..... None
See application file for complete search history.

(56) References Cited

U.S. PATENT DOCUMENTS

2002/0076225 A1* 6/2002 Kurz et al. ..... 399/12
2003/0215248 A1* 11/2003 Silence et al. ..... 399/38
2005/0075135 A1* 4/2005 Cromer et al. ..... 455/558

* cited by examiner

*Primary Examiner*—Vincent Q. Nguyen
(74) *Attorney, Agent, or Firm*—Oliff & Berridge, PLC; Eugene Palazzo

(57) ABSTRACT

A data retrieval method and system are provided that include providing, in a device, a replaceable unit, storing usage data of the device in a database based on information stored in a CRUM used in the replaceable unit, providing access to the database to a user, and providing the usage data to the user. The user data is based on the device performing an operation and the information stored in the CRUM reflecting at least one data point reflecting the performed operation.

20 Claims, 5 Drawing Sheets

METHOD OF PROVIDING DEVICE USAGE DATA

Co-pending applications with Ser. Nos. 11/012,478, 11/034,249, 11/034,248, 11/013,798, 11/012,480, 10/978,423, 11/012,479 and 11/034,058 are incorporated herein in their entirety by reference.

BACKGROUND

1. Field

The present invention relates generally to the utilization of commonly replaced system parts. The invention relates in particular to Customer Replaceable Units (CRU) and Customer Replaceable Unit Monitors (CRUM) used to track device usage data.

2. Description of Related Art

Many machines have replaceable sub-assemblies. Printing machines, for example, may have a number of replaceable sub-assemblies, such as a fuser print cartridge, a toner cartridge, or an automatic document handler. These subassemblies may be arranged as a unit called a cartridge, and if intended for replacement by the customer or machine owner, may be referred to as a Customer Replaceable Unit or CRU. Examples of CRUs may include a printer cartridge, a toner cartridge, or a transfer assembly unit. It may be desirable for a CRU design to vary over the course of time due to manufacturing changes or to solve post-launch problems with either the machine, the CRU, or an interaction between the CRU and the machine. Further, design optimizations may be recognized subsequent to design launch and machine sale, for example, that a relatively simple code update might realize. However, solving these problems, or providing optimization updates, generally requires a service call.

U.S. Pat. No. 4,496,237 to Schron discloses a reproduction machine having a non-volatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the display. In this manner, the status of various consumables can be monitored and appropriate instructions can be displayed for determining replacement. The same information on the alphanumeric display can be remotely transmitted.

U.S. Pat. No. 4,961,088 to Gilliland et al. discloses a monitor/warranty system for electrostatographic reproducing machines in which replaceable cartridges providing a predetermined number of images are used. Each cartridge has an EEPROM programmed with a cartridge identification number that, when matched with a cartridge identification number in the machine, enables machine operation, a cartridge replacement warning count, and a termination count at which the cartridge is disabled from further use. The EEPROM stores updated counts of the remaining number of images left on the cartridge after each print run.

U.S. Pat. No. 5,272,503 to LeSueur et al. discloses a printing machine having operating parameters associated therewith. The printing machine includes a controller for controlling the operating parameters and an operator replaceable sub-assembly adapted to serve as a processing station in the printing machine. The operator replaceable sub-assembly includes a memory device, that communicates with the controller when the replaceable sub-assembly is coupled with the printing machine, for storing a value which varies as a function of the usage of the replaceable subassembly. The controller adjusts a selected one of the operating parameters in accordance with the stored value for maintaining printing quality of the printing machine.

U.S. Pat. No. 6,016,409 to Beard et al. discloses a fuser module comprising a fuser subsystem installable in a xerographic printing apparatus, which includes an electronically-readable memory permanently associated therewith. The control system of the printing apparatus reads out codes from the electronically-readable memory when installed to obtain parameters for operating the module, such as maximum web use, voltage and temperature requirements, and thermistor calibration parameters.

U.S. Patent Publication No. 2003/0215247 to Silence et al. describes a method for operating a machine using at least a first replaceable sub-assembly and at least a second replaceable sub-assembly. The method described comprises providing the first replaceable sub-assembly with a memory, the memory having stored within it a software code upgrade of executable instructions relating to the utilization of the second replaceable sub-assembly. The first replaceable sub-assembly is subsequently placed into the machine, the memory is used and a stored software code upgrade of executable instructions is placed into the machine as new machine software code. Then, the machine is operated with the second replaceable sub-assembly in accordance with the new machine software code.

All of the references indicated above are herein incorporated by reference in their entirety for their teaching.

SUMMARY

Currently, if a user wants to obtain information regarding typical use of a specific device, the user has no practical way to gather such information. Accordingly, providing a way to allow the user to gather typical usage information of a specific device may allow a user to make better educated decisions as to the type of device the user wants to use. Moreover, a manufacturer may use this information to devise better targeted marketing strategies. Also, the manufacturer may use the usage information gathered for a specific device to help customers use the device more efficiently, for example by informing a customer about how many CRUs are to be kept on site at any given time, when should new CRUs be ordered, and the like.

Various implementations provide a data retrieval method that includes providing a device that comprises at least one unit, storing usage data of the device in a database based on information stored in at least one CRUM used in the at least one unit, providing access to the database to a user, and providing the usage data to the user.

Various implementations provide a data retrieval system that includes at least one controller, a device that comprises at least one unit, at least one of the device and the at least one unit being controlled by the at least one controller, a database controlled via the at least one controller, wherein the database is accessible by a user, usage data of the at least one unit being stored in the database via the at least one controller based on information stored in at least one CRUM associated with the at least one unit, and the usage data being provided to the user via the at least one controller.

DETAILED DESCRIPTION OF EXEMPLARY EMBODIMENTS

Figure 1:
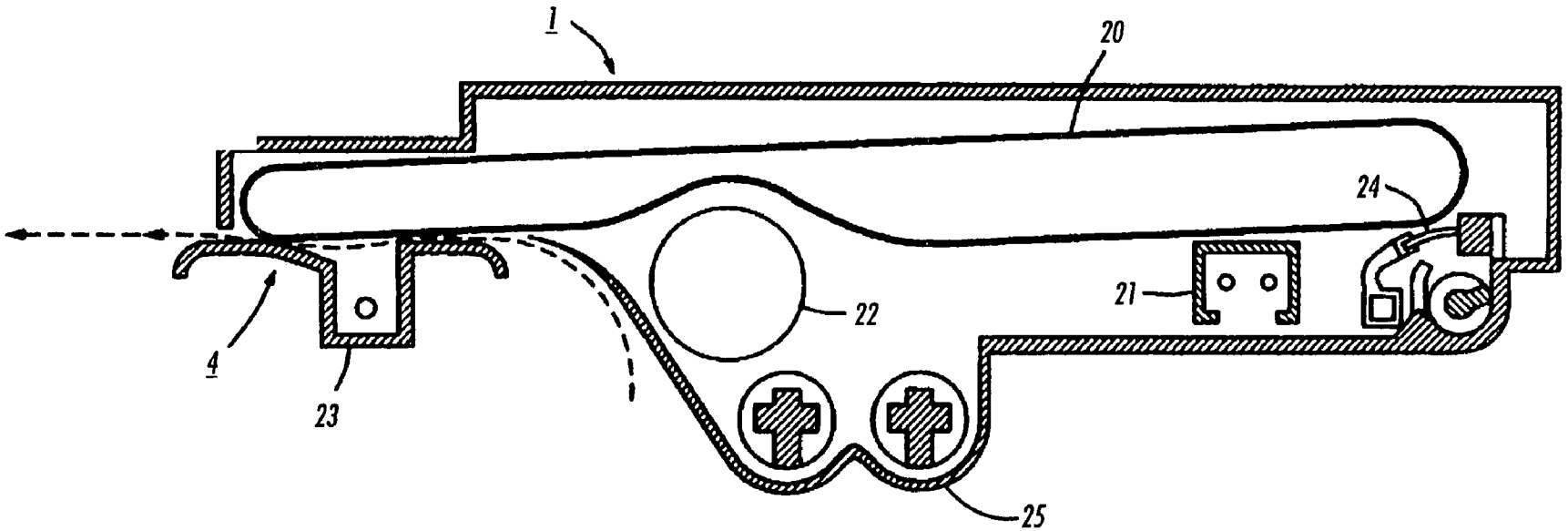
FIG. 1 depicts a cross-sectional view of an exemplary replaceable sub-assembly or CRU for an exemplary machine.

FIG. 1 depicts a cross-sectional view of an exemplary replaceable sub-assembly or CRU for an exemplary machine. The CRU 1 may be similar to that described in U.S. Pat. No. 4,827,308, which is incorporated herein by reference in its entirety. It should be noted that although FIG. 1 describes more specifically a xerographic system, the various implementations described below are applicable to any assembly that contains one or more CRUs such as, for example, a coffee maker, a vacuum cleaner, an automobile, and the like.

In addition to the photoreceptor belt 20, the CRU 1 may include, for example, a charge scorotron 21, a developer device 22, a transfer scorotron 23, a cleaning device 24, and a developer housing 25. The charge scorotron 21 may be located upstream of the imaging slit in the CRU 1 to deposit a uniform electrostatic charge on the surface of the photoreceptor belt 20 before the belt 20 is exposed to the imaging beam 3. The developer device 22 may be located downstream of the imaging slit to bring developer mixture into proximity with, and thereby develop, the electrostatic latent image on the photoreceptor belt 20. The developer mixture may be a two-component mixture comprising toner and a magnetically-attractable carrier. Toner may be transferred to the photoreceptor belt 20 during image development, and replacement toner may be dispensed periodically from a hopper (not shown) into the housing of the developer device 22. The transfer corotron 23 may be located at the transfer station 4 to assist in transferring the developed image from the photoreceptor belt 20 to a copy sheet that enters the CRU 1 at the transfer station 4. Finally, the cleaning device 24 may remove any residual toner particles from the surface of the photoreceptor belt 20, which may then be illuminated by a discharge lamp to remove any electrostatic charge remaining on the photoreceptor belt 20.

Figure 2:
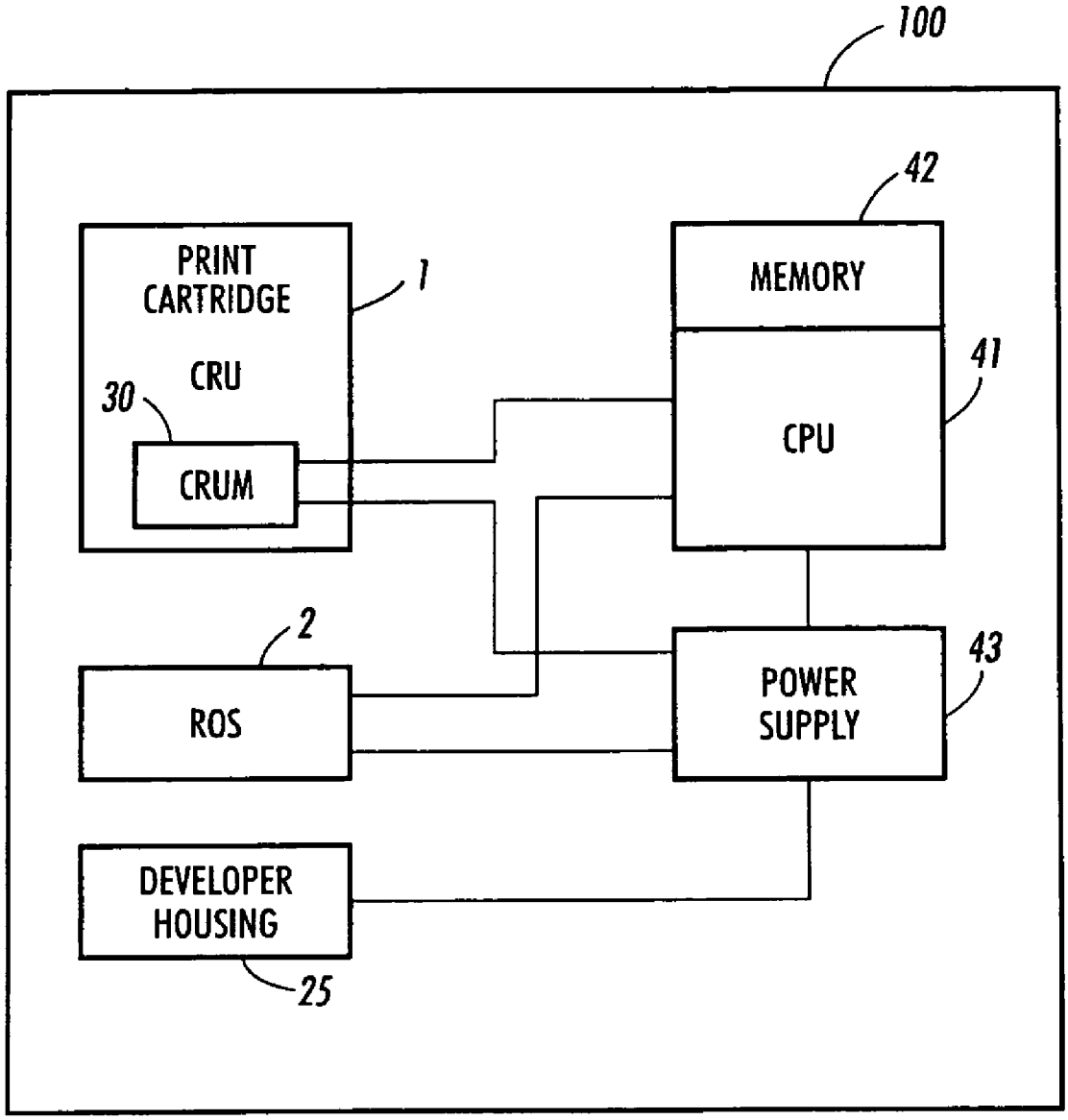
FIG. 2 is a block diagram of various elements in an exemplary machine and their interoperable relationships.

FIG. 2 is a block diagram of various elements in an exemplary machine 100 and their interoperable relationships. The exemplary machine 100 may be a printer/copier, a fax/scanner/printer or any other machine in which a CRU may be useful. Although FIG. 2 describes more specifically a xerographic system, the various implementations described below are applicable to any assembly that contains one or more CRUs such as, for example, a coffee maker, a vacuum cleaner, an automobile, and the like. Within the machine 100 is a CPU 41, which may comprise its own memory 42, either on the same chip-die or locally off-chip. The memory 42 may include bit maps and other stored parameters for use in setpoints utilized within the machine 100. When a power supply 43 of the machine 100 is switched on, the boot sequence in the memory 42, which CPU 41 invokes, may include instructions to poll any CRUs present in the machine 100. The exemplary CRU provided here is the print cartridge CRU 1. As CPU 41 polls CRUs, the CPU 41 checks for indications that there are software updates or tags to invoke. There could be lines of software code or other executable instruction to be read in and substituted. For example, there may be tag indicia that different lines of code are to invoke during the operation of the machine 100. The tag could be as simple as the setting of a single bit, or could be an address pointing to the location of data, lines of code or executable instructions. In all of these alternatives, the tag may be included with the CRU at the time of manufacture or at the point of distribution.

The CPU 41 may also be provided with a code that continually polls for the swapping of a CRU 1. Alternatively, the CPU 41 may respond to an interrupt from the swapping of a CRU 1. In either case, upon determination of a swapped or new CRU 1, the CPU 41 polls the CRU 1 and its memory chip 30, which may be a customer replaceable unit monitor (CRUM), for an indication that there are software updates of executable instructions or new data points to store. It should be noted that, although FIG. 2 indicates that the CRUM is located on the print cartridge, the CRUM may be positioned on the toner, the fuser, the developer, or more generally on any sub-assembly that is part of a greater assembly.

CRUMs are often used to perform design or manufacturing upgrades to, for example, the CRU 1, post launch. As, such, if any material or mechanical upgrade is made to the CRU 1 which improves a particular parameter, then data stored in the CRUM 30 would also be changed on the manufacturing line to reflect this change. Another example is the situation where usage data of the machine 100 must be stored in a memory 30. Accordingly, every time the machine 100 performs an operation, a data point reflecting the operation just performed may be stored in the memory 30. Once data is stored in the memory 30 over a period of time, the data may then be made available to users for retrieval. This data may be used, for example, to determine the historical usage of the particular machine 100, or the particular type of machine to which the machine 100 belongs.

Figure 3:
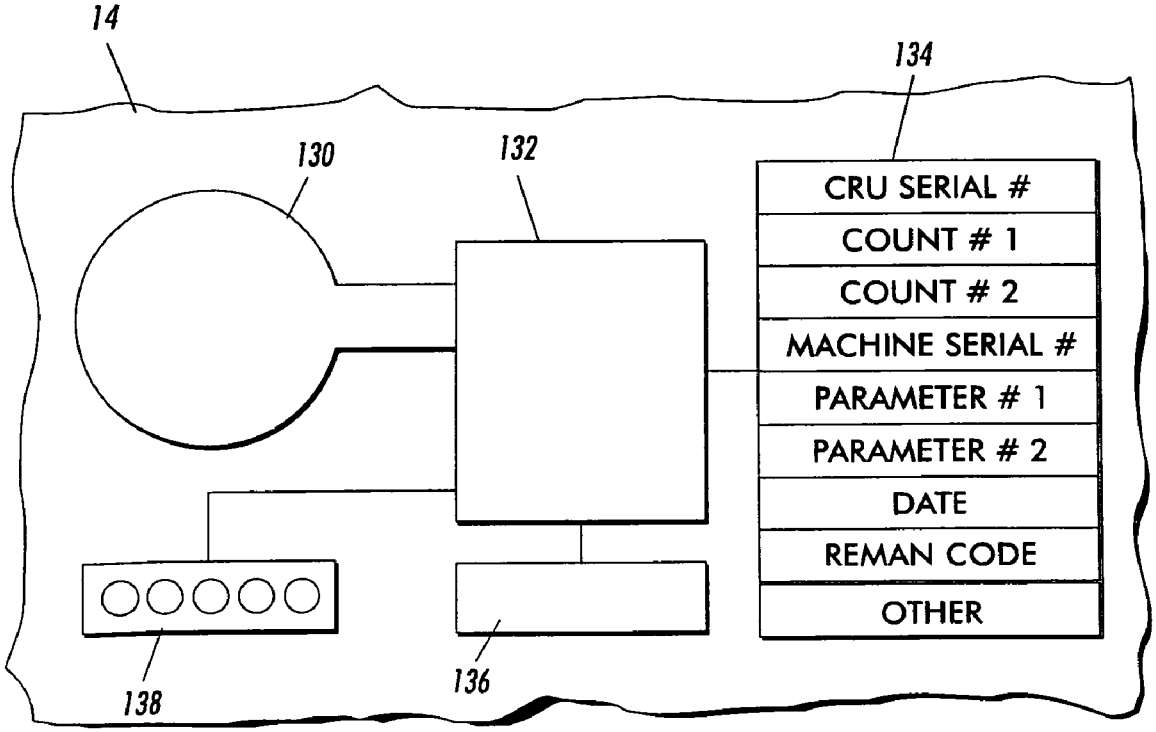
FIG. 3 is a simplified view showing elements of a CRUM operable through wireless means.

FIG. 3 is a simplified view showing elements of an exemplary CRUM operable through wireless means. The CRUM is preferably permanently attached to a surface either on the outside or the inside of a particular module, such as a module 14. In order to operate through wireless means, a CRUM requires some sort of wireless interface, such as an RF loop 130 (along with associated circuitry, the nature of which is well-known), although other wireless interfaces, such as an infrared detector, an ultrasound detector, or some other optical coupling, could be used.

The RF loop 130, which is sensitive to RF signals of a predetermined frequency, is associated with a chip 132. The chip 132 may include circuitry that acts as an interface between the RF loop 30 and a non-volatile memory 134. The non-volatile memory 134 may be disposed within the chip 132, but is shown separately for clarity. The loop 130 may be formed as an etched loop aerial as part of the circuit board forming the CRUM. The chip 132 may also have associated therewith a power supply 136, the exact nature of which will depend on the specific design. The chip 132 includes circuitry for recognizing and processing wireless signals of a particular type which may be detected by the loop 130. The chip 132 may further be provided with a "hard wire" interface 138, which may be adapted to interact with circuitry within the machine such as, for example, a printer.

As shown in FIG. 3, the non-volatile memory 134 includes predetermined locations therein for a module serial number, print counts (for the cumulative use of the module and/or a maximum allowed number of prints to be made with the module), and/or remanufacturing date and code, as needed, such as according to the descriptions of CRUM functions noted above. According to various exemplary implementations, the non-volatile memory 134 can include a large number of other parameters, and the representation of the parameters listed in FIG. 3 is not exhaustive. Also, although FIG. 3 describes more specifically a xerographic system, the various implementations described below are applicable to any assembly that contains one or more CRUs such as, for example, a coffee maker, a vacuum cleaner, an automobile, and the like.

However, if wireless means are used to change data in the memory 134, it may be desirable to recognize that certain data within the memory 134 associated with a particular model should never be changed. For instance, it may be important that the serial number or master print count of the module is never changed, regardless of how often the module is remanufactured. Alternately, if some specific remanufacturing actions are taken on a module, it may be necessary to change only one of the parameters in memory, while leaving the various print counts intact. In such cases, it may be desirable to provide a system in which a special "leave unchanged" code is read into a particular location in the memory 134, this special code being interpreted by the chip 132 as an instruction to leave whatever data is in that particular location in the memory 134 unchanged.

In terms of enabling the above-described CRUM, basic principles of wireless controls of electromechanical and electronic devices, such as garage doors and televisions, are well known. The general principles of operating a CRUM are readily adapted from these arts in view of the present specification.

Figure 4:
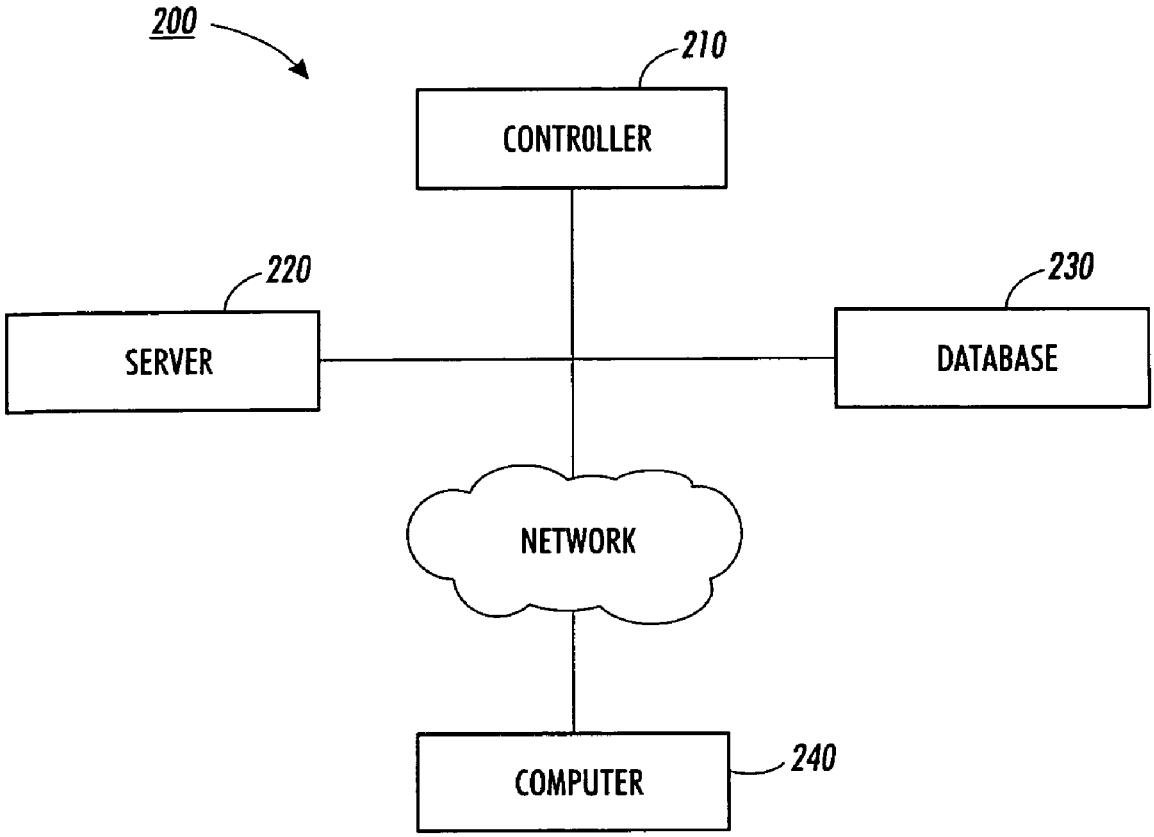
FIG. 4 is an illustration of an exemplary system for retrieving historical usage data of a device.

FIG. 4 is an illustration of an exemplary system 200 for retrieving historical usage data of a device. In FIG. 4, the usage data retrieval system 200 includes a controller 210, a server 220 and a database 230. Access to the system 200 may be allowed via a remote computer 240. The database 230 may be controlled by the controller 210, and usage data for a unit such as, for example, a CRU, in a device that is collected in, for example, a CRUM, may be stored in the database 230 via the controller 210. The database 230 may be functionally coupled to the server 220 in order to allow access to the database 230 to outside users. Outside users may access the historical usage data stored in the database 230 by first accessing the server 220 via a computer 240 remotely connected to the server 220. A user may submit a request form to the server 220 via the remote computer 240 by sending an email or by transmitting the request form through a web application over the internet.

The content of the email and of the request form may be, for example, the device serial number, a device key issued at the time of delivery of the device, and the like. If the email is not properly formatted by the user, the email request may be processed by an operator, but if the email is properly formatted by the user, then the email request may be processed automatically by the server 220 under control of the controller 210 and, for example, forwarded to a sales account representative. The server 220 may also be a secure server, with limited access to the personnel of the entity that manufactures the device in question. In this case, the server 220 may be accessed by authorized personnel to acquire the content of the user request. Then, the database 230 may be securely accessed to acquire the requested data, before transmitting the requested data back to the user. Accordingly, the user may not have direct access to the database 230.

Figure 5:
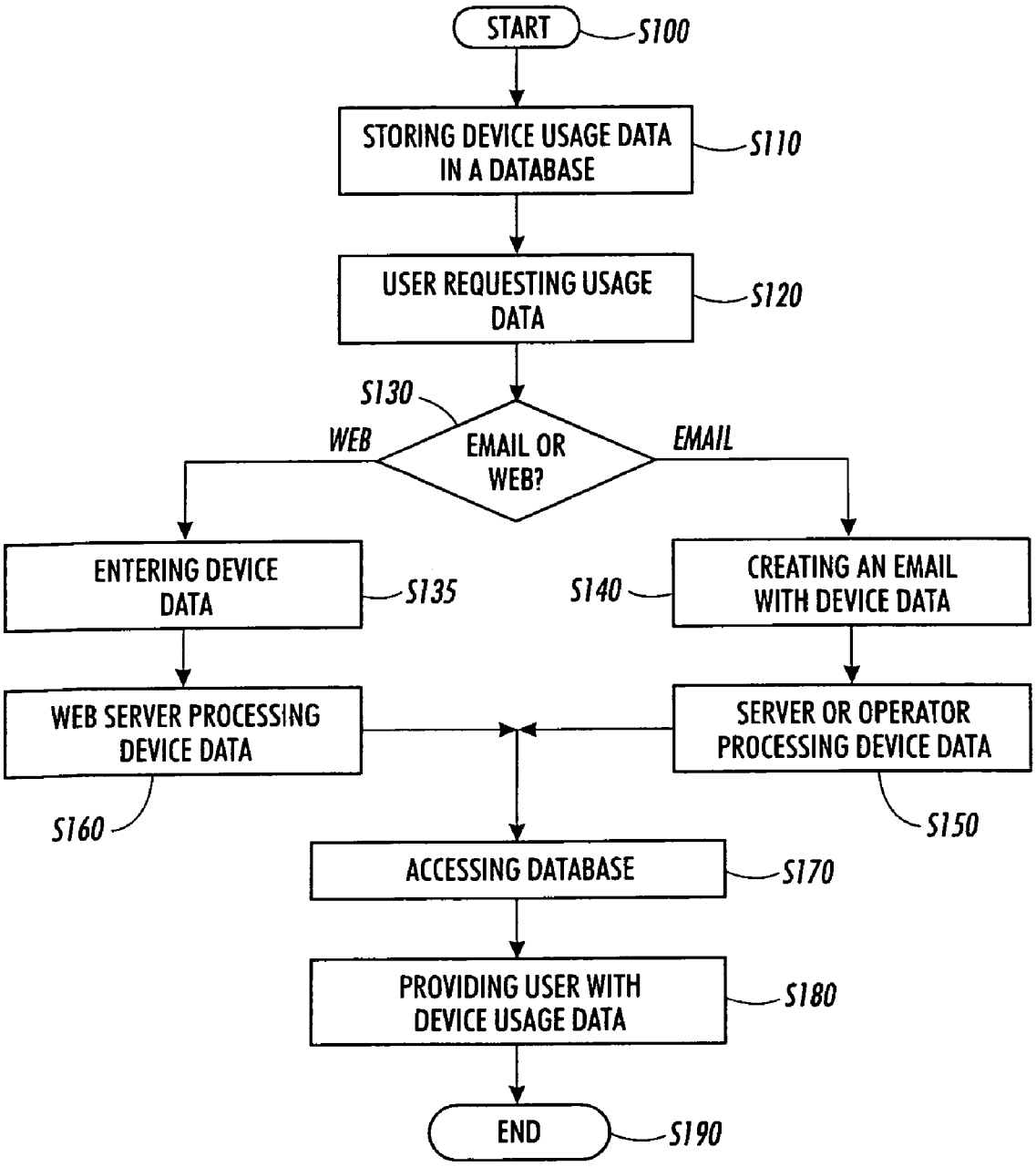
FIG. 5 is a flowchart illustrating an exemplary method of retrieving historical usage data of a device.

FIG. 5 is a flowchart illustrating an exemplary data retrieval method. In FIG. 5, the method starts in step S100 and continues to step S110, where usage data is stored in a database. According to various implementations, since replaceable subassemblies may be equipped with CRUMs, when the replaceable subassemblies are taken out of the overall assembly which they were a part of, the data collected in the CRUMs may be read and transferred into a database. According to various exemplary implementations, the database becomes the repository of the usage data of a multitude of CRUMs that are taken from discarded subassemblies. The database may be organized by a type of device, where the information retrieved from CRUMs that were part of a specific type of device is aggregated. Next, control continues to step S120, where a user requests the usage data for a specific type of device.

During step S120, a user may request usage data for a specific type of device and may choose whether to make the request during step S130 via e-mail or via web. If during step S130, the user chooses to make a request via e-mail, then control continues to step S140. During step S140, an email is created and the type of device for which the user wants usage data is entered. According to various implementations, the email can be created by a user or can be generated automatically based on information provided by the user. According to various implementations, the e-mail may be specially formatted by the user in order to be directly processed by the system that manages the database. Alternatively, the user may send a non-specially formatted e-mail to the system. Next, control continues to step S150, where the request is processed. If the user had sent a specially formatted e-mail during step S140, then during step S150, the specially formatted e-mail may be directly processed by a server. However, if during step S140, the user had sent a non-specially formatted e-mail, then during step S150, an operator may process the e-mail upon receipt.

If during step S130, the user chose to use the web, then control continues to step S135. During step S135, the device data is entered in a specially designed website. According to various exemplary implementations, the data can be entered by the user, uploaded, or can be automatically generated based on information provided by the user. Next, control continues to step S160, where the web server processes the device data entered in the specially designed website during step S135.

Next, control continues to step S170, where the database that stores the historical usage data of various types of devices is accessed. According to various implementations, the database is either accessed automatically by a server or by an operator. According to various exemplary embodiments, access to the database may be secure and limited to authorized employees of the entity that manages the database such as, for example, the producer of the subassemblies. Next, control continues to step S170, where the user is provided with the requested device usage data. According to various exemplary embodiments, the device usage data may be provided to the user either by e-mail or by a screen display that the user may download or print out. Next, control continues to step S190 where the method ends.

While the present invention is described above in connection with various implementations thereof, it will be understood that such details are exemplary and not limiting. On the contrary, various alternatives, modifications and equivalents of the details and implementations described above are contemplated. For example and as discussed above, although the above description is more descriptive of xerographic systems, device usage data can be determined for any assembly that contains customer replaceable units (CRU) such as, for example, a coffee maker for which the CRU is, for example, the bag of coffee, a vacuum cleaner for which the CRU is, for example, the dirt collector, and the like.

What is claimed is:

1. A data retrieval method, comprising:

providing a device that includes at least one replaceable unit;

storing usage data of the device in a database based on information stored in at least one CRUM used in the at least one replaceable unit, wherein the usage data including at least the print count of the cumulative use of the module and a maximum allowed number of prints to be made with the module;

providing access to the database to a user; and providing the usage data from the database to the user, wherein in at least a plurality of instances when the device performs an operation, data points reflecting the performed operation are stored in the CRUM as the information.

2. The method of claim 1, wherein providing access to the database comprises:

providing access to the database via an email that is formatted in a specific format, wherein the email comprises at least one of a device serial number and a device key.

3. The method of claim 2, wherein the email is received by a mail server associated with the database.

4. The method of claim 2, further comprising routing a properly formatted email to a sales account representative.

5. The method of claim 2, further comprising processing an improperly formatted email by an operator.

6. The method of claim 1, wherein providing access to the database comprises:

providing access to the database via internet, wherein the user transmits at least one of a device serial number and a device key.

7. The method of claim 6, further comprising validating the at least one of a device serial number and a device key by a web application that guides a user through a request form.

8. The method of claim 7, further comprising transmitting the request form to a web server.

9. The method of claim 8, further comprising transmitting the request form to a secure server.

10. The method of claim 1, wherein the usage data is provided to the user via email.

11. A machine-readable medium that provides instructions for retrieving data from a database, the instructions, when executed by a processor, cause the processor to perform the method of claim 1.

12. A data retrieval system, comprising:

at least one controller;

a device that includes at least one replaceable unit, at least one of the device and the at least one replaceable unit being controlled by the at least one controller;

a database controlled via the at least one controller, wherein the database is accessible by a user;

usage data of the at least one unit being stored in the database via the at least one controller based on information stored in at least one CRUM associated with the at least one replaceable unit, wherein the usage data including at least the print count of the cumulative use of the module and a maximum allowed number of prints to be made with the module; and the usage data being provided to the user via the at least one controller, wherein in at least a plurality of instances when the device performs an operation, data points reflecting the performed operation are stored in the CRUM as the information.

13. The system of claim 12, further comprising:

the at least one controller allowing access to the database via an email, the email being formatted in a specific format and comprising at least one of a device serial number and a device key.

14. The system of claim 13, wherein the email is received in a mail server associated with the database.

15. The system of claim 13, further comprising:

the at least one controller routing a properly formatted email to a sales account representative.

16. The system of claim 13, further comprising:

the at least one controller controlling an improperly formatted email to be processed by an operator.

17. The system of claim 12, further comprising:

the at least one controller allowing access to the database via internet, wherein the user transmits at least one of a device serial number and a device key to the database via internet.

18. The system of claim 17, further comprising:

the at least one controller controlling the validation of the at least one of a device serial number and a device key through a web application that guides the user through a request form.

19. The system of claim 18, further comprising:

the at least one controller controlling a transmission of the request form to a web server.

20. The system of claim 18, further comprising:

the at least one controller controlling a transmission of the request form to a secure server.

* * * * *